United States Patent [19]

Hamano et al.

[11] Patent Number: 4,553,441

[45] Date of Patent: Nov. 19, 1985

[54] STARTING SYSTEM FOR INTERNAL COMBUSTION ENGINE

[75] Inventors: Isao Hamano; Akira Morishita; Yoshifumi Akae; Toshinori Tanaka; Kiyoshi Yabunaka, all of Himeji, Japan

[73] Assignee: Mitsubishi Denki Kabushiki Kaisha, Tokyo, Japan

[21] Appl. No.: 543,455

[22] Filed: Oct. 18, 1983

[51] Int. Cl.[4] ..... F02N 11/00

[52] U.S. Cl. ..... 74/7 R; 290/38 R; 310/92

[58] Field of Search ..... 74/7 R, 7 C; 290/38 R, 290/38 A, 38 B, 38 C, DIG. 1; 310/92, 78, 100; 192/45

[56] References Cited

U.S. PATENT DOCUMENTS

| | | | |
|---|---|---|---|
| 2,795,711 | 6/1957 | Miller | 310/78 |
| 3,991,734 | 11/1976 | Martin | 123/179 E |
| 4,169,447 | 10/1979 | Furzer | 74/7 R X |
| 4,232,521 | 11/1980 | Gali Mallofre | 60/612 |
| 4,257,281 | 3/1981 | Bunger | 74/6 |
| 4,304,140 | 12/1981 | Ebihara | 192/45 X |
| 4,327,300 | 4/1982 | Hoven | 74/7 C X |
| 4,464,576 | 8/1984 | Williams | 74/7 C X |
| 4,479,394 | 10/1984 | Greenwood et al. | 74/6 X |
| 4,488,054 | 12/1984 | Ebihara | 74/6 X |
| 4,562,429 | 3/1985 | Ebihara | 123/179 J |

*Primary Examiner*—William E. Tapolcai

*Attorney, Agent, or Firm*—Wenderoth, Lind & Ponack

[57] ABSTRACT

A starting system for an internal combustion engine, comprising a stator; a cylindrical rotor which is arranged on an inner peripheral side of the stator with a predetermined gap therefrom; an overrunning clutch which includes a first cylindrical clutch body that is mounted on an inner peripheral surface of the rotor, and a second cylindrical clutch body that is clutch-coupled with the first clutch body; a rotary shaft which is penetratingly arranged on an inner peripheral portion of the second clutch body of the overrunning clutch, which is axially movable relative to the second clutch body and which rotates along with the second clutch body; a pinion which is disposed at one end of the rotary shaft and which is brought into meshing engagement with a ring gear of the engine being a first load device; a power transmission mechanism which is disposed at the other end of the rotary shaft and which transmits power to a second load device; and a shift lever which slides the rotary shaft in the axial direction thereof so as to connect a turning force of the rotary shaft to either of the first load device or the second load device.

6 Claims, 2 Drawing Figures

STARTING SYSTEM FOR INTERNAL COMBUSTION ENGINE

BACKGROUND OF THE INVENTION

This invention relates to improvements in a starting system for internal combustion engines.

FIG. 1 shows a prior-art starting system for an internal combustion engine. Referring to the figure, numeral 1 designates a starter, and numeral 2 a motor which generates rotating power. A spline tube 3 is held in spline engagement with the rotary shaft 4 of the motor 2 in a manner to be slidable frontwards and backwards on the rotary shaft 4, and it has a pinion 5 fastened to the front end part thereof. A shift lever 6 is held in engagement with the spline tube 3 by the insertion of the former in a recess 3*a* provided in the outer peripheral surface of the latter, and it is swiveled about a fulcrum 6*a* by a solenoid plunger 7 so as to move the pinion 5 in the direction of arrow A or B. Numeral 8 indicates a gear which is brought into meshing engagement with the pinion 5 when this pinion is reset, and which is fastened to a power take-off shaft 9. Numeral 10 indicates a journal box in which the power take-off shaft 9 is journaled. A flywheel 11 is fastened to the crankshaft 12 of an engine (not shown), and a ring gear 13 is snugly fitted (shrinkage fitted) onto the outer peripheral surface of an end part of the flywheel 11.

In operation, when the solenoid plunger 7 is energized, the shift lever 6 is swiveled about the fulcrum 6*a* by the urging force of the plunger. Thus, the spline tube 3 is shifted frontwards (in the direction of arrow A) on the rotary shaft 4, and the pinion 5 is brought into meshing engagement with the ring gear 13. Thereafter, when the motor 2 is started to generate a turning force, the ring gear 13 is rotated, and the engine, being a first load, is started through the crankshaft 12. Subsequently, when the solenoid plunger 7 is deenergized, the spline tube 3 is reset in the direction of arrow B through the shift lever 6, and the mesh between the pinion 5 and the ring gear 13 is released. The resetting operation brings the pinion 5 into mesh with the spur gear 8. In this state, the motor 2 is rotating. Accordingly the gear 8 is rotated through the pinion 5, and a second load such as a pump, not shown, is driven by the power take-off shaft 9.

The prior-art system is as stated above, and the power take-off shaft 9 for driving the second load such as the pump is installed in a manner to be spaced from the motor 2. This has led to such a disadvantage that the system becomes complicated in structure and large in size on account of problems involved in the mounting of the starter.

SUMMARY OF THE INVENTION

This invention has been made in order to eliminate the disadvantage of the prior-art system as described above, and has for its object to provide a starting system for an internal combustion engine in which a pinion shaft is adapted to slide, and a ring gear to engage a first load device and a ring gear to engage a second load device are respectively disposed at the front and rear end parts of the pinion shaft, whereby excellent effects to be described later are brought forth.

In accordance with one aspect of this invention, a starting system for an internal combustion engine comprises a stator; a cylindrical rotor (armature) which is arranged on an inner peripheral side of said stator with a predetermined gap therefrom; an overrunning clutch which includes a first cylindrical clutch body that is mounted on an inner peripheral surface of said rotor, and a second cylindrical clutch body that is clutch-coupled with said first clutch body; a rotary shaft which is penetratingly arranged on an inner peripheral portion of said second clutch body of said overrunning clutch, which is axially movable relative to said second clutch body and which rotates along with said second clutch body; a pinion which is disposed at one end of said rotary shaft and which is brought into meshing engagement with a ring gear of the engine being a first load device; a power transmission mechanism which is disposed at the other end of said rotary shaft and which transmits power to a second load device; and a shift lever which slides said rotary shaft in the axial direction thereof so as to connect a turning force of said rotary shaft to either of the first load device or the second load device.

DESCRIPTION OF THE PREFERRED EMBODIMENT

Figure 1:
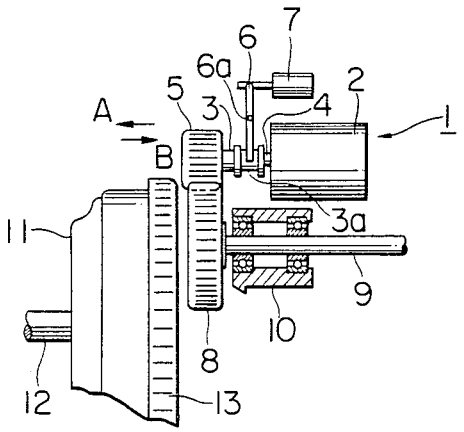
FIG. 1 PRIOR ART
FIG. 1 is a front view, partly in section, for explaining the arrangement of a prior-art starting system for an internal combustion engine.
Figure 2:
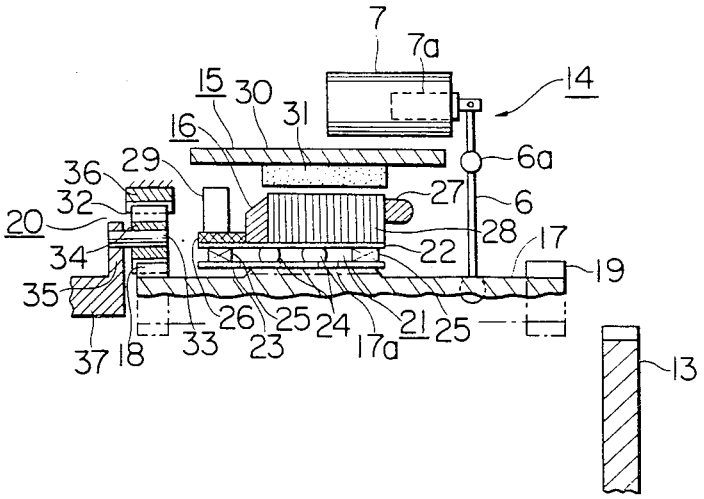
FIG. 2 is a front view, partly in section, showing a starting system for an internal combustion engine according to an embodiment of this invention.

Now, an embodiment of this invention will be described with reference to the drawing. In FIG. 2, numeral 14 designates a starter motor, numeral 15 a field system including a stator, numeral 16 an armature (armature rotor), and numeral 17 a rotary shaft. The rotary shaft 17 is constructed as a slide shaft which is shifted rightwards and leftwards as viewed in the figure by a shift lever 6. The rotary shaft 17 has a gear 18 and a pinion 19 at respective end parts thereof, and is mounted so as to protrude beyond both the end parts of the armature 16. In the illustrated state, the gear 18 is held in meshing engagement with planetary reduction gears 20. In a case where the shaft 17 is shifted frontwards (rightwards as viewed in the figure) by the shift lever 6, (herein, the shaft 17 is readily shifted by the thrust of a helical spline 17*a* formed in the surface of the shaft), the pinion 19 is brought into mesh with the ring gear 13 of the engine. Shown at numeral 7 is an electromagnetic switch, the plunger 7*a* of which is associated with the shift lever 6. Numeral 21 indicates an overrunning clutch device. The device 21 is constructed of a clutch-outer cylinder 22 which is mounted on the inner peripheral surface of the armature 16, a clutchinner cylinder 23 which is spline-fitted with the shaft 17, and friction rollers 24 which are snugly fitted so as to bite in the narrowing direction of a wedge-shaped space defined between the members 22 and 23. Shown at numerals 25 are sleeve bearings which are fitted in the inner peripheral space of the clutch-outer cylinder 22 and in which the rotary shaft 17 is slidably journaled. Numeral 26 designates a commutator, numeral 27 an armature coil, numeral 28 an armature core, and numeral 29 a brush held in sliding contact with the commutator 26. The field system 15 is constructed of a cylindrical yoke 30, and poles 31 formed of permanent magnet members fastened on the inner peripheral surface of the yoke 30. Numeral 32 denotes a planet gear which constitutes the planetary reduction gears 20. A supporting pin 33 is pivotally mounted on the inner peripheral surface of a sleeve bearing 34 fitted on the inner peripheral surface of the planet gear 32, which journals the planet gear 32, and is fitted in a flange 35 having the function of an arm. Numeral 36 denotes an internal gear (ring gear) which the planet gear 32 engages by inner gearing, and numeral 37 an output take-off shaft which is fastened to the flange 35.

In operation, when the electromagnetic switch 7 is energized, the plunger *7a* is attracted into the casing thereof to move leftwards as viewed in the figure. The shift lever 6 is turned counterclockwise as viewed in the figure about a turning fulcrum *6a*, and the rotary shaft 17 held in engagement with the lower end part of the shift lever 6 is shifted frontwards (rightwards as viewed in the figure), so that the pinion 19 is brought into mesh with the ring gear 13. Thereafter, a D.C. power source comprising a battery (not shown) is connected to the brush 29. Upon receiving the exciting forces of the field system 15, the armature 16 generates a turning force. This turning force is transmitted to the rotary shaft 17 through the overrunning clutch device 21, and the ring gear 13 is rotated through the pinion 19. Thus, the engine is started. After the starting of the engine, the pinion 19 is urged to over-rotate by the ring gear 13. However, only the rotary shaft 17 is over-rotated owing to the function of the unidirectional turning-force engagement of the overrunning clutch device 21 (the turning force is transmitted in only one rotating direction), whereby the armature 16 is prevented from overrotating and is freely rotated with no load. Subsequently, when the electromagnetic switch 7 is deenergerized, the solenoid plunger *7a* is reset into the illustrated state. Then, the pinion 19 is released from the ring gear 13, and the gear 18 is brought into mesh with the planet gear 32 of the planetary reduction gears 20. When the armature 16 is energized under this state (the state of FIG. 2), the turning force thereof is transmitted to the output take-off shaft 37 after the speed of rotation is lowered by the planetary reduction gears 20. Thus, the second load device (for example, an oil pump) as required is driven.

The embodiment has been explained as to the case where the planetary reduction gears 20 are interposed between the rotary shaft 17 and the output take-off shaft 37 with which the second load device is held in engagement. However, both the shafts 17 and 37 may well be directly held in engagement by gear or spline engagement or the like. In this case, there is attained the effect that the system becomes very simple.

As set forth above, according to this invention, the overrunning clutch is installed in the inner peripheral space of the armature core, the rotary shaft penetrating through the interior of the armature is arranged so as to be slidable frontwards and rearwards, and the pinion which is brought into meshing engagement with the ring gear of the engine forming the first load is disposed at the front end part of the rotary shaft, while the gear which is brought into meshing engagement with the power take-off shaft for driving the second load such as the pump is fastened to the rear end part thereof. Therefore, the second load device is mounted coaxially with the rotary shaft 17 of the armature, which is advantageous for the installation. Moreover, when the system is used for starting the engine, the second load does not become a load on the starter motor, and when it is used for driving the second load, it does not function as the starter, so that a system of high reliability is provided by the small-sized and simple arrangement. The invention brings forth such effects.

What is claimed is:

1. A starting system for an internal combustion engine, comprising a stator; a cylindrical armature rotor which is arranged on an inner peripheral side of said stator with a predetermined gap therefrom; an overrunning clutch which includes a first cylindrical clutch body that is mounted on an inner periperal surface of said rotor, and a second cylindrical clutch body that is clutch-coupled with said first clutch body; a rotary shaft which is penetratingly arranged on an inner peripheral portion of said second clutch body of said overrunning clutch, which is axially movable relative to said second clutch body and which rotates along with said second clutch body; a pinion which is disposed at one end of said rotary shaft and which is brought into meshing engagement with a ring gear of the engine being a first load device; a power transmission mechanism which is disposed at the other end of said rotary shaft and which transmits power to a second load device; and a shift lever which slides said rotary shaft in the axial direction thereof so as to connect a turning force of said rotary shaft to either of the first load device or the second load device.

2. A starting system for an internal combustion engine according to claim 1, wherein said first clutch body is formed of an outer cylinder and said second clutch body is formed of an inner clutch cylinder inside said outer clutch cylinder, said overrunning clutch further comprising friction rollers snugly fitted so as to bite in a narrowing direction of a wedge-shaped space defined between said outer clutch cylinder and said inner clutch cylinder.

3. A starting system for an internal combustion engine according to claim 1, wherein said second clutch body of said overrunning clutch and said rotary shaft are spline-connected.

4. A starting system for an internal combustion engine according to claim 1, wherein said power transmission mechanism comprises gearing.

5. A starting system for an internal combustion engine according to claim 4, wherein said gearing is comprises of planetary reduction gears.

6. A starting system for an internal combustion engine according to claim 1, wherein said power transmission mechanism comprises a spline portion formed in said rotary shaft.

* * * * *